United States Patent [19]

Riehl

[11] 4,118,175

[45] Oct. 3, 1978

[54] FUEL BURNER, ARRANGEMENT AND SLEEVE THEREFOR AND METHODS

[75] Inventor: Fred Riehl, Greensburg, Pa.

[73] Assignee: Robertshaw Control Company, Richmond, Va.

[21] Appl. No.: 754,114

[22] Filed: Dec. 27, 1976

[51] Int. Cl.[2] ..... F23D 13/40

[52] U.S. Cl. ..... 431/354; 48/180 C; 48/180 F

[58] Field of Search ..... 431/354, 217, 355; 48/180 F, 180 C, 180 R; 239/580; 251/343, 344, 284; 29/157.1 R

[56] References Cited

U.S. PATENT DOCUMENTS

| | | | |
|---|---|---|---|
| 3,351,118 | 11/1967 | Ward | 48/180 F |
| 3,874,839 | 4/1975 | Fiehl | 48/180 F |
| 3,905,756 | 9/1965 | Ferlin et al. | 431/354 |

*Primary Examiner*—Carroll B. Dority, Jr.
*Attorney, Agent, or Firm*—Candor, Candor & Tassone

[57] ABSTRACT

An adjustable air shutter arrangement for a tubular fuel burner wherein a sleeve is telescoped on the tubular burner for sliding relative thereto to progressively cover and uncover air inlet openings of the fuel burner, the sleeve having a longitudinal slot splitting the sleeve from one opposed end to the other opposed end thereof to define two adjacent longitudinal slot edges of the sleeve. The sleeve has a natural bias that causes the sleeve to grip the tubular burner and tend to move the longitudinal edges thereof together whereby the sleeve tends to frictionally remain in its telescoped position on the tubular burner by its natural gripping bias. The sleeve has tabs on the longitudinal edges to facilitate the spreading apart of the longitudinal edges to thereby permit easy sliding of the sleeve relative to the tubular burner. The sleeve has opposed stops for respectively engaging a projection of the burner that extends through the slot of the sleeve to limit longitudinal sliding movement of the sleeve in opposite directions on the tubular burner. The stops comprise inward steps in the longitudinal edges of the sleeve.

20 Claims, 7 Drawing Figures

FUEL BURNER, ARRANGEMENT AND SLEEVE THEREFOR AND METHODS

This invention relates to an improved fuel burner arrangement and sleeve therefor as well as to a method of making the fuel burner arrangement and a method of making the sleeve therefor.

Adjustable air shutter arrangements for controlling the primary air intake for fuel burners are well known in the art.

For example, one such adjustable air shutter arrangement comprises a tubular fuel burner provided with opening means at one end thereof and a split sleeve telescoped on the burner for sliding relative thereto to progressively cover and uncover the opening means and thereby provide an adjustable air shutter arrangement.

However, it has been found according to the teachings of this invention that such split sleeve was either too loose on the burner or gripped the same so tightly that it was very hard to slide the sleeve relative to the tubular burner to provide for accurate primary air throttling.

Therefore, it is a feature of this invention to provide such a split sleeve adjustable air shutter arrangement that is easy to adjust.

In particular, one embodiment of this invention provides a fuel burner arrangement wherein a tubular burner has opening means at one end thereof and a sleeve telescoped on the burner for sliding relative thereto to progressively cover and uncover the opening means and thereby provide an adjustable air shutter arrangement, the sleeve having a longitudinal slot splitting the same from one opposed end to the other opposed end thereof and thereby defining two adjacent longitudinal slot edges of the sleeve. The sleeve has a natural bias that causes the sleeve to grip the tubular burner and tend to move the longitudinal edges thereof together whereby the sleeve tends to frictionally remain in its telescoped position on the tubular burner by its natural gripping bias. The sleeve has tab means on the longitudinal edges for facilitating the spreading apart of the longitudinal edges to thereby permit easy sliding of the sleeve relative to the tubular burner. The sleeve has opposed stop means for respectively engaging a guide projection means of the burner that extends through the slot of the sleeve to limit longitudinal sliding movement of the sleeve in opposite directions on the tubular burner. The stop means comprise inward steps in the longitudinal edges of the sleeve.

Accordingly, it is an object of this invention to provide an improved fuel burner arrangement having one or more of the novel features of this invention as set forth above or hereinafter shown or described.

Another object of this invention is to provide a method of making such a burner arrangement, the method of this invention having one or more of the novel features of this invention as set forth above or hereinafter shown or described.

Another object of this invention is to provide a sleeve for such a burner arrangement, the sleeve of this invention having one or more of the novel features of this invention as set forth above or hereinafter shown or described.

Another object of this invention is to provide a method of making such a sleeve, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein.

Figure 1:
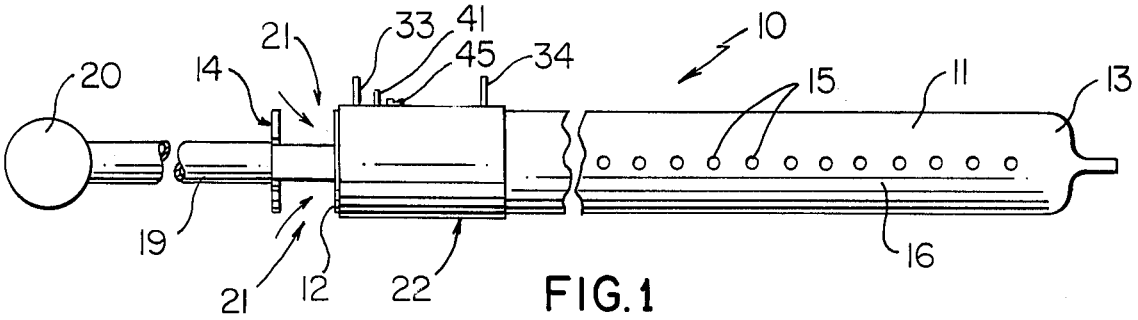
FIG. 1 is a side view illustrating the fuel burner arrangement of this invention.

While the various features of this invention are hereinafter described and illustrated as being particularly adapted to provide an air shutter arrangement for a fuel burner, it is to be understood that the various features of this invention can be utilized singly or in any combination thereof to provide an air shutter arrangement for other devices as desired.

Therefore, this invention is not to be limited to only the embodiment illustrated in the drawings, because the drawings are merely utilized to illustrate one of the wide variety of uses of this invention.

Referring now to FIG. 1 the improved fuel burner arrangement of this invention is generally indicated by the reference numeral 10 and comprises a tubular burner 11 having opposed ends 12 and 13 with the end 13 being closed and the end 12 being opened and carrying a fuel conduit mounting retainer 14. The tubular burner 11 has a plurality of ports 15 formed through the side wall means or external peripheral surface 16 thereof for issuing fuel from the interior of the tubular burner 11 to be ignited and burned in a conventional manner for cooking purposes or the like.

Figure 4:
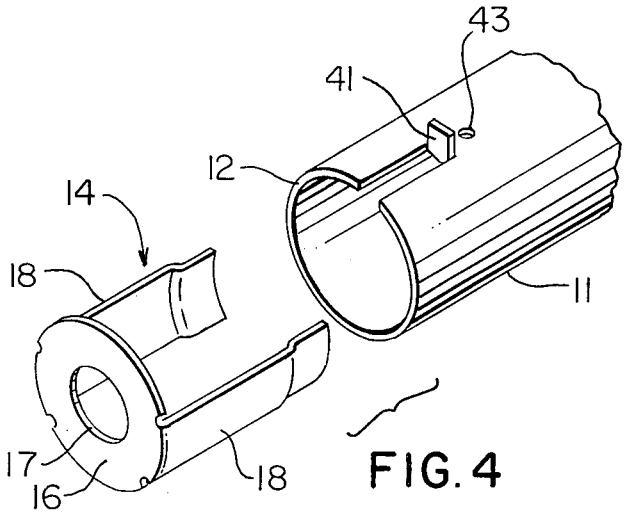
FIG. 4 is an enlarged exploded fragmentary perspective view of the tubular burner of the burner arrangement of FIG. 1.
Figure 5:
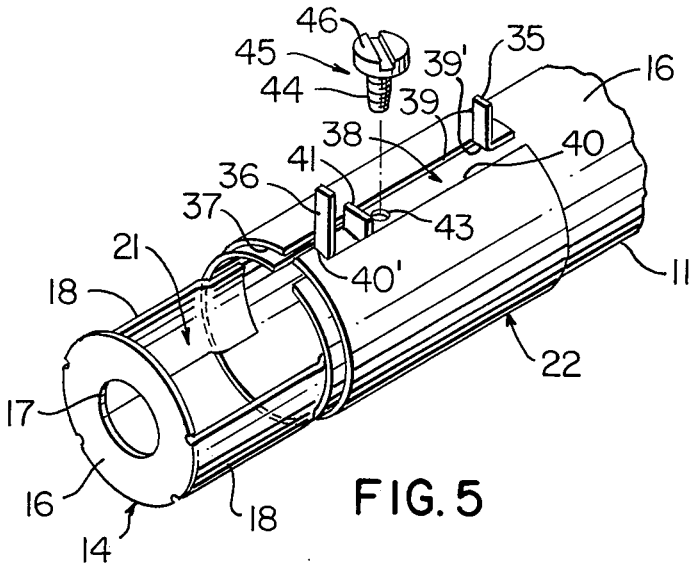
FIG. 5 is an enlarged fragmentary perspective view of the air shutter arrangement of the burner arrangement of FIG. 1.

As illustrated in FIGS. 1, 4 and 5, the retainer 14 includes a disc-like member 16 having an opening 17 passing centrally therethrough and carrying two legs 18 which are adapted to project into the end 12 of the tubular burner 11 and be fastened thereto in any suitable manner, such as by spot welding or the like, whereby a fuel conduit 19, FIG. 1, can lead from a fuel source 20 and project into the opening 17 of the retainer 14 and into the opened end 12 of the tubular burner 11 to issue fuel therein from the source 20.

As fuel is directed by the pipe 19 into the interior of the tubular burner 11, air adjacent and external to retainer 14 is drawn into the end 12 of the tubular burner 11 in a manner well known in the art to provide primary air for subsequently mixing with the fuel in the burner 11 and issuing out of the ports 15 to be burned, the retainer 14 defining opening means 21 between the legs 18 thereof for permitting such air to be drawn into the end 12 of the tubular burner 11.

In order to control the amount of air being drawn into the tubular burner 11 through the opening means 21 of the burner 11, a sleeve 22 of this invention is utilized and is substantially tubular so as to be telescopically disposed on the tubular burner 11 to slide relative thereto in a manner hereinafter described to progressively cover or progressively uncover the opening means 21 as desired as to control the amount of primary air entering the opening means 21.

Figure 2:
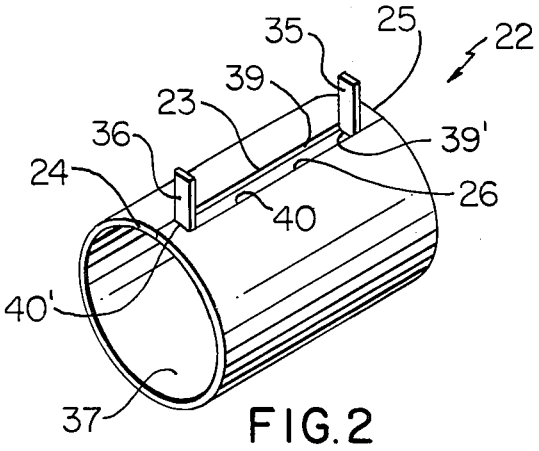
FIG. 2 is an enlarged perspective view illustrating the adjustable sleeve for the burner arrangement of FIG. 1.
Figure 3:
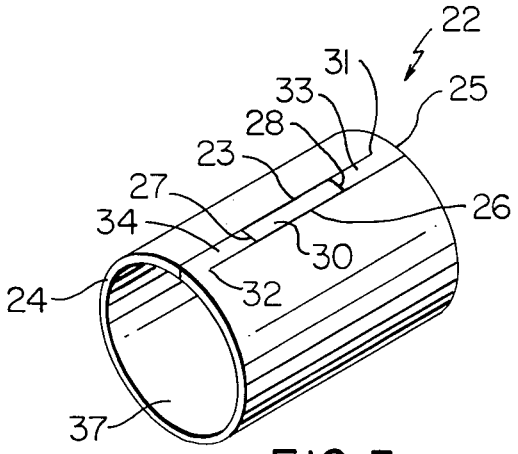
FIG. 3 is a view similar to FIG. 2 and illustrates one step in the method of making the sleeve of FIG. 2.

The sleeve 22 as best illustrated in FIG. 2 can be originally formed from a cylindrical tube as illustrated in FIG. 3 and be slit along a longitudinal line 23 from one end 24 of the sleeve 22 to short of the other end 25 thereof while another longitudinal slit 26 is made in the sleeve 22 from the end 25 to just short of the end 24 while being spaced and parallel to the slit 23 as illustrated. Two cross slits 27 and 28 can be formed to join the slits 23 and 26 together so that a part 30 of the sleeve 22 will be completely cut therefrom by the joining of the slits 23, 26, 27 and 28.

The cross slits 28 and 27 are respectively inwardly spaced from the respective ends 31 and 32 of the slits 23 and 26 so that the portions 33 and 34 of the sleeve 22 outboard of the cross slits 28 and 27 and between the slits 23 and 26 can be upwardly bent substantially at right angles to the sleeve 22 to form upstanding tabs 35 and 36 as illustrated in FIGS. 2 and 5.

The diameter of the sleeve 22 relative to the diameter of the tubular burner 11 is so chosen that when the sleeve 22 is telescopically disposed on the burner 11 as illustrated in FIG. 5, the internal peripheral surface 37 of the sleeve 22 tends to frictionally grip the external peripheral surface 16 of the tubular burner 11 because the outside diameter of the burner 11 is greater than the inside diameter of the sleeve 22. In this manner, a slot 38 is formed between the two resulting longitudinal edges 39 and 40 of the sleeve 22 that tends to move toward each other due to the natural bias of the sleeve 22 tending to close the longitudinal edges 39 and 40 against each other as illustrated in FIG. 2.

Thus, it can be seen that the longitudinal edges 39 and 40 are each stepped to define outwardly directed steps 39' and 40' respectively forming the base portions of the upstanding tabs 35 and 36 as illustrated in FIG. 5.

If desired, an upstanding tongue or tab 41 can be formed from the end 12 of the burner 11 to be received in the slot 38 of the sleeve 22 to guide sliding movement of the sleeve 22 relative to the burner 11 with the tab 41 being of such width that the same does not prevent the sleeve 22 from collapsing the longitudinal edges 39 and 40 toward each other to frictionally grip the tubular burner 11.

By having such upstanding tab 41 on the tubular burner 11, the steps 39' and 40' in the sleeve 22 will respectively engage against opposed sides of the tab 41 if the sleeve 22 is moved relative to the burner 11 a sufficient distance whereby the cooperation of the steps 39' and 40' or the tabs 35 and 36 with the tab 41 limits the axial movement of the sleeve 22 relative to the tubular burner 11 in both directions thereon.

Therefore, it can be seen that the sleeve 22 of this invention can be formed in a relatively simple manner by the method of this invention previously described to operate as an air shutter sleeve with the tubular burner 11 in a manner now to be described.

Figure 6:
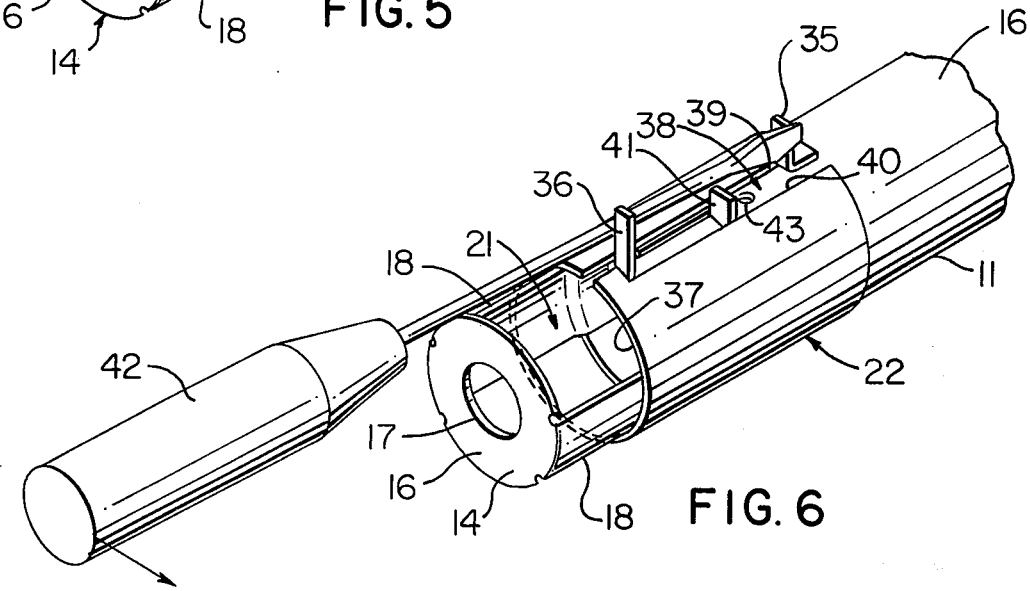
FIG. 6 is a view similar to FIG. 5 and illustrates one step in the method of adjusting the air shutter arrangement of FIG. 5.
Figure 7:
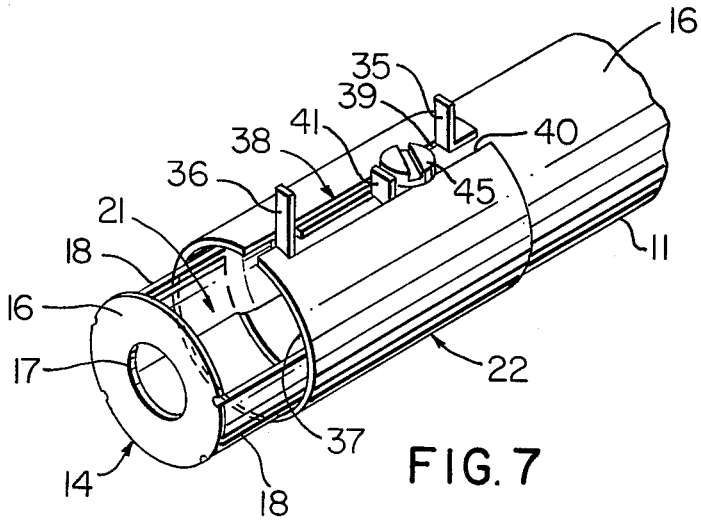
FIG. 7 is a view similar to FIG. 5 and illustrates the air shutter of FIG. 5 in another adjusted position thereof.

With the sleeve 22 disposed in the condition illustrated in FIG. 5, and it is desired to move the sleeve 22 to partially cover the opening means 21 in the manner illustrated in FIG. 7 and thereby cut down on the amount of primary air that will enter the opening means 21 of the burner 11, a person merely takes a screw driver 42, or other similar tool, and prys between the tabs 35 and 36 as illustrated in FIG. 6 to spread apart the longitudinal edges 39 and 40 of the sleeve 22 and thereby relieve the binding or bias effect of the sleeve 22 against the tubular burner 11 so that the same can be readily moved to the desired telescoped position on the tubular burner 11 as illustrated in FIGS. 6 and 7. Upon a release of the screw driver 42 from between the tabs 35 and 36, the sleeve 22 can now grip against the tube 11 by moving the longitudinal edges 39 and 49 thereof toward each other through the natural bias of the sleeve 22 to frictionally hold the sleeve 22 in the adjusted position of FIG. 7. Thus, it can be seen that the sleeve 22 can be easily adjusted relative to the tubular burner 11 through the use of the tabs 35 and 36 of the sleeve 22 in the above manner.

However, it may be desired to positively lock the sleeve 22 in any of its adjusted positions whereby a threaded opening 43 can be formed in the tube 11 adjacent the tab 41 thereof to receive a threaded shank 44 of a threaded fastening member 45 in such a manner that an enlarged head 46 of the threaded fastening member 45 will be disposed over the longitudinal edges 39 and 40 of the sleeve 22 to compact the same downwardly against the tubular burner 11 as illustrated in FIG. 7 to positively lock the sleeve 22 in the adjusted position thereof when the fastening member 45 is tightened against the sleeve 22.

Therefore, it can be seen that when the fastening member 45 is utilized, and when one wants to adjust the sleeve 22 relative to the tubular burner 11, the screw driver 42 can be utilized to back off the fastening member 45 from its compacting condition of FIG. 7 so that the same while remaining in the opening 43 of the tubular burner 11 does not bind the sleeve 22 thereto so that the screw driver 42 can be utilized to spread apart the tab 35 and 36 as illustrated in FIG. 6 to permit the sleeve 22 to be adjusted to the new position thereof as previously described. Thereafter, the screw driver 42 can be utilized to tighten the fastening member 45 to its locking position for holding the sleeve 22 in its adjusted position.

Therefore, it can be seen that this invention not only provides an improved tubular burner arrangement and method of making the same, but also this invention provides an improved sleeve for such a burner arrangement and method of making the same.

While the forms and methods of this invention, now preferred have been illustrated and described as required by the Patent Statute, it is to be understood that other forms and method steps can be utilized and still fall within the scope of the appended claims.

What is claimed is:

1. In a fuel burner arrangement having a tubular burner provided with opening means at one end thereof and a sleeve telescoped on said burner for sliding relative thereto to progressively cover and uncover said opening means and thereby provide an adjustable air shutter arrangement, said sleeve having opposed ends and a longitudinal slot splitting said sleeve from one of said ends to the other of said ends and thereby defining two adjacent longitudinal slot edges of said sleeve, said sleeve having a natural bias that causes said sleeve to grip said tubular burner and tend to move said longitudinal edges thereof together whereby said sleeve tends to frictionally remain in its telescoped position on said tubular burner by its natural gripping bias, said sleeve having tab means on said longitudinal edges for facilitating the spreading apart of said longitudinal edges and thereby permit easy sliding of said sleeve relative to said tubular burner, said tubular burner having a projection means extending therefrom and being received through said slot of said sleeve to guide longitudinal sliding movement of said sleeve relative to said burner, the improvement wherein said sleeve has opposed stop means for respectively engaging said projection means of said burner to limit longitudinal sliding movement of said sleeve in opposite directions on said tubular burner, said stop means comprising inward steps in said longitudinal edges of said sleeve.

2. A fuel burner arrangement as set forth in claim 1 wherein each longitudinal edge has just one such step therein.

3. A fuel burner arrangement as set forth in claim 2 wherein said tab means of said sleeve comprises an upwardly extending tab at each step thereof to facilitate spreading apart said sleeve for sliding adjustment thereof relative to said tubular burner.

4. A fuel burner arrangement as set forth in claim 1 wherein said burner has a locking means for locking said sleeve in its adjusted telescoped relation on said tubular burner.

5. A fuel burner arrangement as set forth in claim 1 wherein said tab means of said sleeve comprises a pair of tabs extending outwardly therefrom to faciltate spreading apart said sleeve for sliding adjustment thereof relative to said tubular burner.

6. In a fuel burner arrangement having a tubular burner provided with opening means at one end thereof and a sleeve telescoped on said burner for sliding relative thereto to progressively cover and uncover said opening means and thereby provide an adjustable air shutter arrangement, said sleeve having opposed ends and a longitudinal slot splitting said sleeve from one of said ends to the other of said ends and thereby defining two adjacent longitudinal slot edges of said sleeve, said sleeve having a natural bias that causes said sleeve to grip said tubular burner and tend to move said longitudinal edges thereof together whereby said sleeve tends to frictionally remain in its telescoped position on said tubular burner by its natural gripping bias, said sleeve having tab means on said longitudinal edges for facilitating the spreading apart of said longitudinal edges and thereby permit easy sliding of said sleeve relative to said tubular burner, said burner having a locking means for locking said sleeve in its adjusted telescoped relation on said tubular burner, the improvement wherein said locking means comprises a threaded fastening member that has a threaded shank threadedly carried by said burner and passing through said slot of said sleeve and has an enlarged head for straddling and compacting against said longitudinal edges of said sleeve to lock said sleeve in its adjusted telescoped relation on said tubular burner.

7. A fuel burner arrangement as set forth in claim 5 wherein said tabs are respectively located at opposite ends of said longitudinal edges of said sleeve.

8. In a method of making a fuel burner arrangement having a tubular burner provided with opening means at one end thereof and a sleeve telescoped on said burner for sliding relative thereto to progressively cover and uncover said opening means and thereby provide an adjustable air shutter arrangement, said sleeve having a longitudinal slot splitting said sleeve from one opposed end thereof to the other opposed end thereof and thereby defining two adjacent longitudinal slot edges of said sleeve, said sleeve having a natural bias that causes said sleeve to grip said tubular burner and tend to move said longitudinal edges thereof together whereby said sleeve tends to frictionally remain in its telescoped position on said tubular burner by its natural gripping bias, said sleeve having tab means on said longitudinal edges for faciltating the spreading apart of said longitudinal edges and thereby permit easy sliding of said sleeve relative to said tubular burner, said tubular burner having projection means extending therefrom and being received through said slot of said sleeve to guide longitudinal sliding movement of said sleeve relative to said burner, the improvement comprising the steps of forming said sleeve with opposed stop means for respectively engaging said projection means of said burner to limit longitudinal sliding movement of said sleeve in opposite directions on said tubular burner, and forming said stop means as inward steps in said longitudinal edges of said sleeve.

9. A method of making a fuel burner arrangement as set forth in claim 8 wherein each longitudinal edge has just one such step therein.

10. A method of making a fuel burner arrangement as set forth in claim 9 and including the step of forming said tab means of said sleeve to comprise an upwardly extending tab at each step thereof to facilitate spreading apart said sleeve for sliding adjustment thereof relative to said tubular burner.

11. A method for making a fuel burner arrangement as set forth in claim 8 and including the step of forming said burner with a locking means for locking said sleeve in its adjusted telescoped relation on said tubular burner.

12. In a method for making a fuel burner arrangement having a tubular burner provided with opening means at one end thereof and a sleeve telescoped on said burner for sliding relative thereto to progressively cover and uncover said opening means and thereby provide an adjustable air shutter arrangement, said sleeve having a longitudinal slot splitting said sleeve from one opposed end thereof to the other opposed and thereof and thereby defining two adjacent longitudinal slot edges of said sleeve, said sleeve having a natural bias that causes said sleeve to grip said tubular burner and tend to move said longitudinal edges thereof together whereby said sleeve tends to frictionally remain in its telescoped position on said tubular burner by its natural gripping bias, said sleeve having tab means on said longitudinal edges for facilitating the spreading apart of said longitudinal edges and thereby permit easy sliding of said sleeve relative to said tubular burner, said burner having a locking means for locking said sleeve in its adjusted telescoped relation on said tubular burner, the improvement comprising the step of forming said locking means from a threaded fastening member that has a threaded shank threadedly carried by said burner and passing through said slot of said sleeve and has an enlarged head for straddling and compacting against said longitudinal edges of said sleeve to lock said sleeve in its adjusted telescoped relation on said tubular burner.

13. A method of making a fuel burner arrangement as set forth in claim 8 and including the step of forming said tab means of said sleeve to comprise a pair of tabs extending outwardly therefrom to facilitate spreading apart said sleeve for sliding adjustment thereof relative to said tubular burner.

14. A method of making a fuel burner arrangement as set forth in claim 13 and including the step of forming said tabs so as to be respectively located at opposite ends of said longitudinal edges of said sleeve.

15. A sleeve for telescoping on a tubular fuel burner and for sliding relative thereto to progressively cover and uncover opening means at one end of said burner and thereby provide an adjustable air shutter arrangement, said sleeve having opposed ends and a longitudinal slot splitting said sleeve from one of said ends to the other of said ends and thereby defining two adjacent longitudinal slot edges of said sleeve, said sleeve having a natural bias that is adapted to cause said sleeve to grip said tubular burner and tend to move said longitudinal edges thereof together whereby said sleeve will be adapted to frictionally remain in its telescoped position on said tubular burner by its natural gripping bias, said sleeve having tab means on said longitudinal edges thereof to facilitate the spreading apart of said longitudinal edges and thereby permit easy sliding of said sleeve relative to said tubular burner, said sleeve having opposed stop means adapted for respectively engaging a projection means of said burner to limit longitudinal sliding movement of said sleeve in opposite directions on said tubular burner, said stop means comprising inward steps in said longitudinal edges of said sleeve.

16. A sleeve as set forth in claim 15 wherein each longitudinal edge has just one such step therein.

17. A sleeve as set forth in claim 16 wherein said tab means of said sleeve comprises an upwardly extending tab at each step thereof to facilitate spreading apart said sleeve for sliding adjustment thereof relative to said tubular burner.

18. In a method of making a sleeve for telescoping on a tubular fuel burner and for sliding relative thereto to progressively cover and uncover opening means at one end of said burner and thereby provide an adjustable air shutter arrangement, said sleeve having a longitudinal slot splitting said sleeve from one opposed end thereof to the other opposed end thereof and thereby defining two adjacent longitudinal slot edges of said sleeve, said sleeve having a natural bias that is adapted to cause said sleeve to grip said tubular burner and tend to move said longitudinal edges thereof together whereby said sleeve is adapted to frictionally remain in its telescoped position on said tubular burner by its natural gripping bias, said sleeve having tab means on said longitudinal edges of said sleeve to facilitate the spreading apart of said longitudinal edges and thereby permit easy sliding of said sleeve relative to said burner, said sleeve having opposed stop means adapted for respectively engaging a projection means of said burner to limit longitudinal sliding movement of said sleeve in opposite directions on said tubular burner, the improvement comprising the step of forming said stop means as inward steps in said longitudinal edges of said sleeve.

19. A method as set forth in claim 18 wherein each longitudinal edge has just one such step therein.

20. A method as set forth in claim 19 and including the step of forming said tab means of said sleeve to comprise an upwardly extending tab at each step thereof to facilitate spreading apart said sleeve for sliding adjustment thereof relative to said tubular burner.

* * * * *